US008427397B2

(12) United States Patent
Kwon et al.

(10) Patent No.: US 8,427,397 B2
(45) Date of Patent: Apr. 23, 2013

(54) LIGHT EMITTING DIODE DISPLAY DEVICE

(75) Inventors: Yong-Il Kwon, Gumi-si (KR); Kyoung-Don Woo, Gumi-si (KR); Jae-Do Lee, Jung-ri (KR)

(73) Assignee: LG Display Co., Ltd., Seoul (KR)

( * ) Notice: Subject to any disclaimer, the term of this patent is extended or adjusted under 35 U.S.C. 154(b) by 905 days.

(21) Appl. No.: 12/498,722

(22) Filed: Jul. 7, 2009

(65) Prior Publication Data

US 2010/0006783 A1 Jan. 14, 2010

(30) Foreign Application Priority Data

Jul. 10, 2008 (KR) ..... 10-2008-0067133

(51) Int. Cl.
*G09G 3/14* (2006.01)

(52) U.S. Cl.
USPC ..... 345/46; 345/76

(58) Field of Classification Search ..... 345/76, 345/46
See application file for complete search history.

(56) References Cited

U.S. PATENT DOCUMENTS

2004/0061671 A1* 4/2004 Kawasaki et al. ..... 345/76
2004/0257353 A1 12/2004 Imamura et al.
2005/0212444 A1 9/2005 Lee et al.
2007/0008269 A1 1/2007 Kimura
2008/0007499 A1* 1/2008 Kawabe ..... 345/82

OTHER PUBLICATIONS

Search Report issued in corresponding European Patent Application No. 09162672.1; issued Nov. 11, 2009.

* cited by examiner

*Primary Examiner* — Amare Mengistu
*Assistant Examiner* — Shawna Stepp Jones
(74) *Attorney, Agent, or Firm* — Brinks Hofer Gilson & Lione

(57) ABSTRACT

The present disclosure relates to a light emitting diode display device which can prevent a drive switching device from degrading. The light emitting diode display device includes a plurality of pixel cells each having a light emitting diode, a plurality of data lines for transmission of data signal having information on a picture, a plurality of gate lines for transmission of a gate signal having a gate high voltage, a first gate low voltage, and a second gate low voltage having a polarity opposite to the data signal, wherein the gate high voltage, the first gate low voltage and the second gate low voltage having potentials different from one another wherein each of the pixel cells includes a signal transmission switching device for connecting the data line to a node according to the first gate high voltage from the gate line, a drive switching device for controlling an intensity of a drive current being supplied to the light emitting diode according to a signal state of the node, a storage capacitor connected between the node and a source electrode or a drain electrode of the drive switching device, and a control switching device for connecting the gate line to the node in response to the second gate low voltage from the gate line and a control signal from a control line.

5 Claims, 5 Drawing Sheets

LIGHT EMITTING DIODE DISPLAY DEVICE

RELATED APPLICATIONS

This application claims the benefit of the Patent Korean Application No. 10-2008-0067133, filed on Jul. 10, 2008, which is hereby incorporated by reference as if fully set forth herein.

BACKGROUND

1. Field of the Disclosure

The present invention relates to, light emitting diode display devices, and, more particularly, to a light emitting diode display device which can prevent a drive switching device from degrading.

2. Discussion of the Related Art

Currently, various flat display devices are under developing, which has weight and volume smaller than a cathode ray tube, and especially, the light emitting display device having excellent light emitting efficiency, brightness and an angle of view, and a fast responsive speed, is paid attention.

A light emitting device has a structure in which a light emitting layer which is a light emitting thin film disposed between a cathode and an anode for injecting an electron and a hole into the light emitting layer to make the electron and the hole to recombine, which causes generation of an exciter that emits a light as the exciter drops to a lower energy level.

The light emitting layer of the light emitting device is formed of inorganic or organic material, and depending on the material of the light emitting layer, the light emitting device is called either as an inorganic light emitting device, or an organic light emitting device.

A drive switching device controls the intensity of a driving current to the light emitting device. That is, the drive switching device controls the intensity of the driving current in response to a data signal from a gate electrode for the drive switching device. However, since the data signal always has a positive polarity or a negative polarity, keeping a threshold voltage of the drive switching device to increase in one direction as a drive time period of the drive switching device increases, there has been a problem in that the drive switching device is degraded.

BRIEF SUMMARY

A light emitting diode display device includes a plurality of pixel cells each having a light emitting diode, a plurality of data lines for transmission of data signal having information on a picture, a plurality of gate lines for transmission of a gate signal having a gate high voltage, a first gate low voltage, and a second gate low voltage having a polarity opposite to the data signal, wherein the gate high voltage, the first gate low voltage and the second gate low voltage having potentials different from one another wherein each of the pixel cells includes a signal transmission switching device for connecting the data line to a node according to the first gate high voltage from the gate line, a drive switching device for controlling an intensity of a drive current being supplied to the light emitting diode according to a signal state of the node, a storage capacitor connected between the node and a source electrode or a drain electrode of the drive switching device, and a control switching device for connecting the gate line to the node in response to the second gate low voltage from the gate line and a control signal from a control line.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SYMBOLS ON KEY PARTS IN THE DRAWINGS

Tr_T: signal transmission switching device

Tr_D: drive switching device Tr_C: control switching device n: node DL: data line GL: gate lineCst: storage capacitor VDD: first driving power source VSS: second driving power source OLED: light emitting device Data: data signal CS: control signal GS: gate signal

DETAILED DESCRIPTION OF THE DRAWINGS AND THE PRESENTLY PREFERRED EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
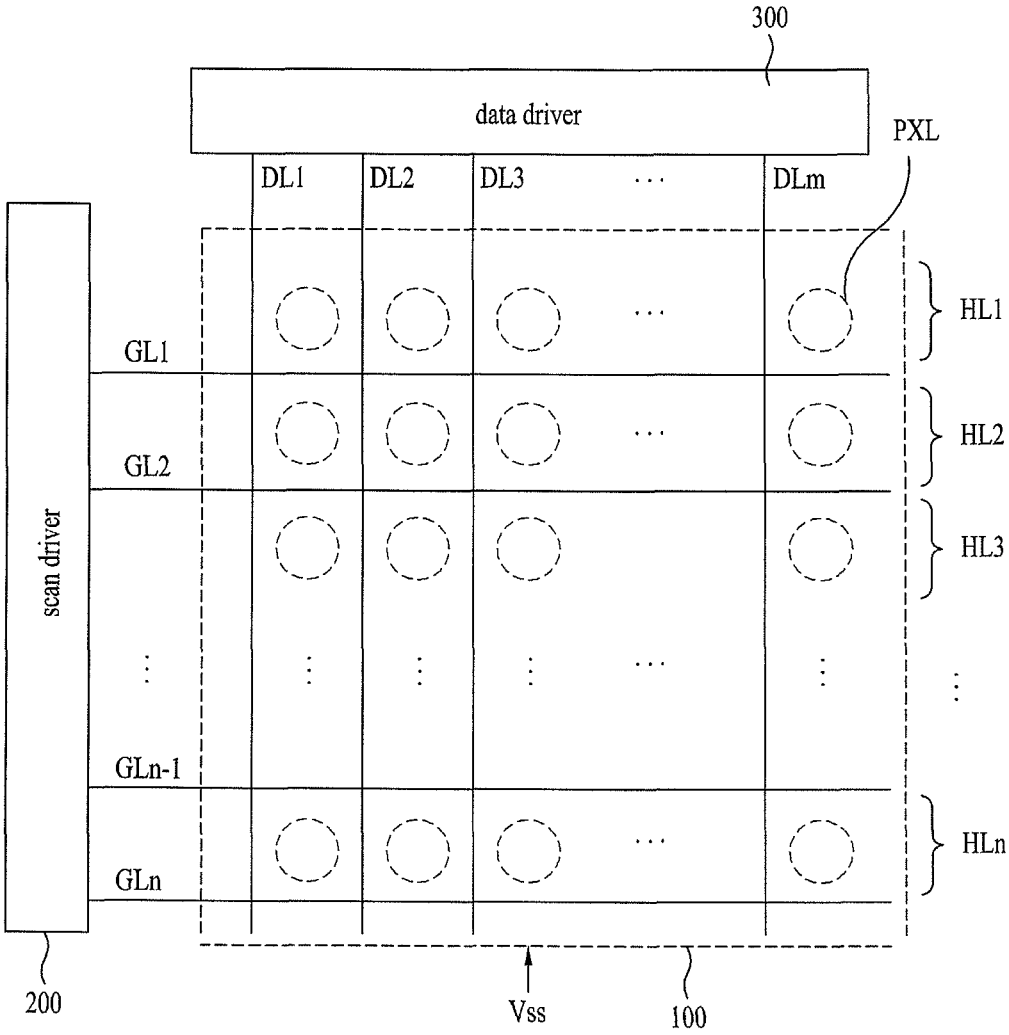
FIG. 1 illustrates a diagram of a light emitting display device in accordance with a preferred embodiment of the present disclosure.
Figure 2:
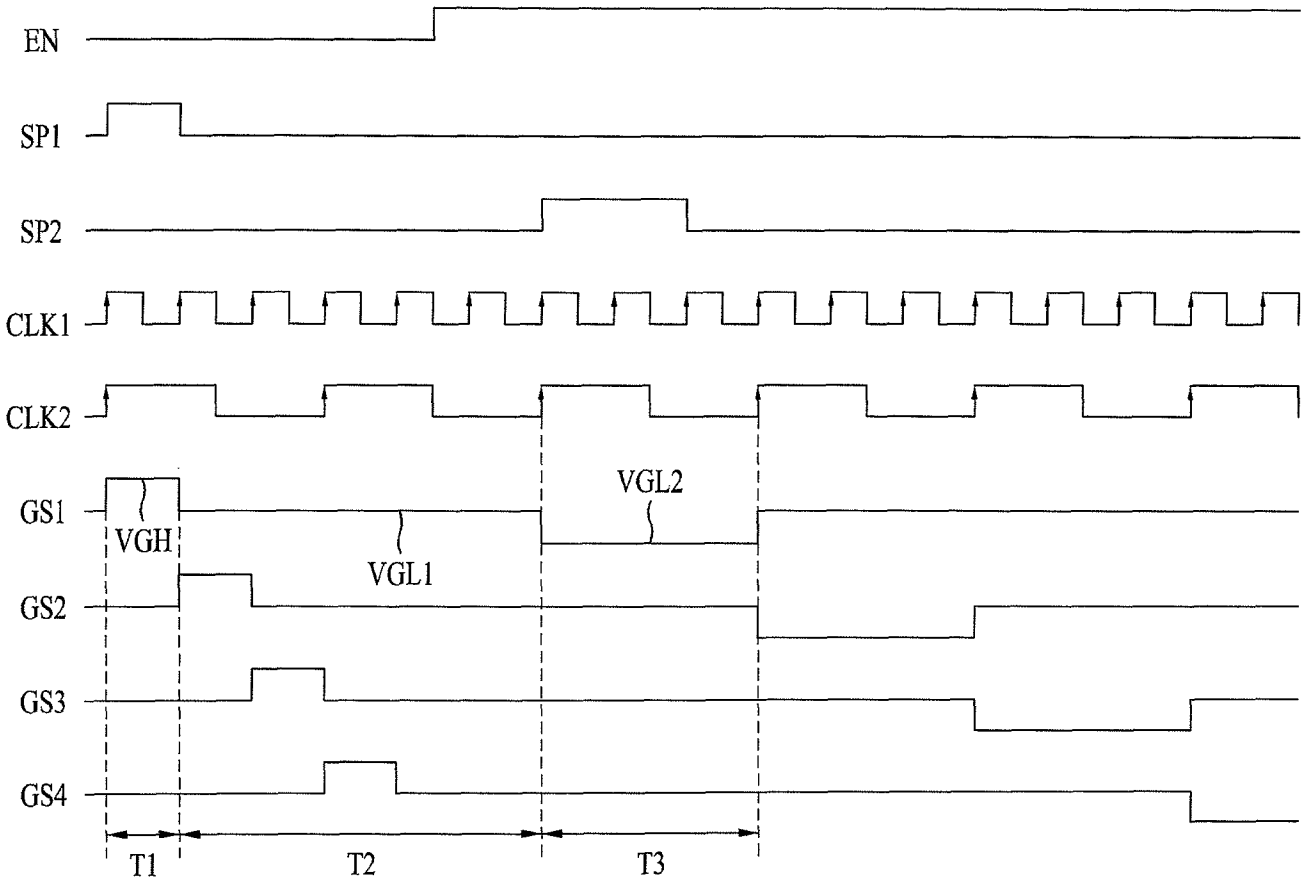
FIG. 2 illustrates a diagram of waveforms of various signals supplied to the light emitting diode in FIG. 1.

FIG. 1 illustrates a diagram of a light emitting display device in accordance with a preferred embodiment of the present disclosure, and FIG. 2 illustrates a diagram of waveforms of various signals supplied to the light emitting diode in FIG. 1.

Referring to FIG. 1, the light emitting display device includes m (m is a natural numeral) data lines DL1~DLm for applying a data signal thereto, n (n is a natural numeral different from m) gate lines GL1~GLn for applying a gate signal thereto, a first drive power line (not shown) for supplying first power VDD therethrough, a second drive power line (not shown) for supplying second power VSS therethrough, a display unit 100 having a plurality of pixel cells PXL, a gate driver 200 for driving the gate lines GL1~GLn, and a data driver 300 for supplying a data signal data having information on a picture to the data lines DL1~DLm.

The gate driver 200 generates gate signals GS1~GSn by using start pulses SP1 and SP2 and clock signals CLK1 and CLK2 and supplies the gate signals GS1~GSn to the gate lines GL1~GLn respectively. As shown in FIG. 2, the gate signals GS1~GSn respectively supplied to the gate lines GL1~GLn have a gate high voltage VGH, a first gate low voltage VGL1 and a second gate low voltage VGL2. The gate high voltage VGH, the first gate low voltage VGL1 and the second gate low voltage VGL2 have potentials different from one another. That is, the first gate low voltage VGL1 has a potential lower than the gate high voltage and the second gate low voltage VGL2 has a potential lower than the first gate low voltage VGL1. Particularly, the second gate low voltage VGL2 has a polarity opposite to a polarity of the data signal. In this instance, as described before, since the data signal Data has a positive polarity, the second gate low voltage VGL2 has a negative polarity. If the data signal Data has a negative polarity, the second gate low voltage VGL2 will have a positive polarity.

The gate driver 200 generates the gate high voltage VGH and the first gate low voltage VGL1 by using the first start pulse SP1, and the first clock signal CLK1 of the gate signal and the second gate low voltage VGL2 of the gate signal by using the second start pulse SP2 and the second clock signal CLK2. In other words, the gate driver 200 shifts the first start pulse SP1 according to the first clock signal CLK1 to generate the gate high voltages VGH and the first gate low voltages VGL1 required for the gate lines in succession. The gate driver 200 also shifts the second start pulse SP2 according to the second clock signal CLK2 to generate the second gate low voltages VGL2 required for the gate lines in succession. Accordingly, the gate high voltage VGH is generated at every rising edge of the first clock signal CLK1, and the second gate low voltage VGL2 is generated at every rising edge of the second clock signal CLK2.

The first and second start pulses SP1 and SP2 are provided only once within one frame period. That is, though the first and second clock signals CLK1 and CLK2 become active (a high state) many times periodically within one frame period, the first and second start pulses SP1 and SP2 become active only once within one frame period. The second start pulse SP2 is provided later than the first start pulse SP1, and the second start pulse SP2 has a pulse width greater than the first start pulse SP1. In the meantime, the first start pulse SP1 has a frequency two times greater than the second start pulse SP2.

The data driver 300 generates the data signal Data and supplies to the data line DL1 to DLm in response to data control signals which are not shown. In this instance, the data driver 300 supplies one horizontal portion of the data signal Data to each of the data lines DL1 to DLm in every horizontal period. The data signal Data may have a positive or negative polarity, and the present invention will be described based on a data signal Data having a positive polarity.

m pixel cells PXL on a horizontal line are connected to one gate line in common and to m data lines respectively. For an example, all of first to m(th) pixel cells PXL arranged along a first horizontal line HL1 are connected to the first gate line GL1 and the first to m(th) pixel cells PXL are connected to the first to m(th) data lines DL1 to DLm, respectively. In other words, the first pixel cell PXL of the first horizontal line HL1 is connected to the first data line DL1, the second pixel cell PXL of the first horizontal line HL1 is connected to the second data line DL2, the third pixel cell PXL of the first horizontal line HL1 is connected to the third data line DL3, - - - , and the m(th) pixel cell PXL of the first horizontal line HL1 is connected to the m(th) data line DL2.

The first and second drive power lines and the control line are connected to all of the pixel cells PXL in common.

A structure of the pixel cell PXL will be described in more detail.

Figure 3:
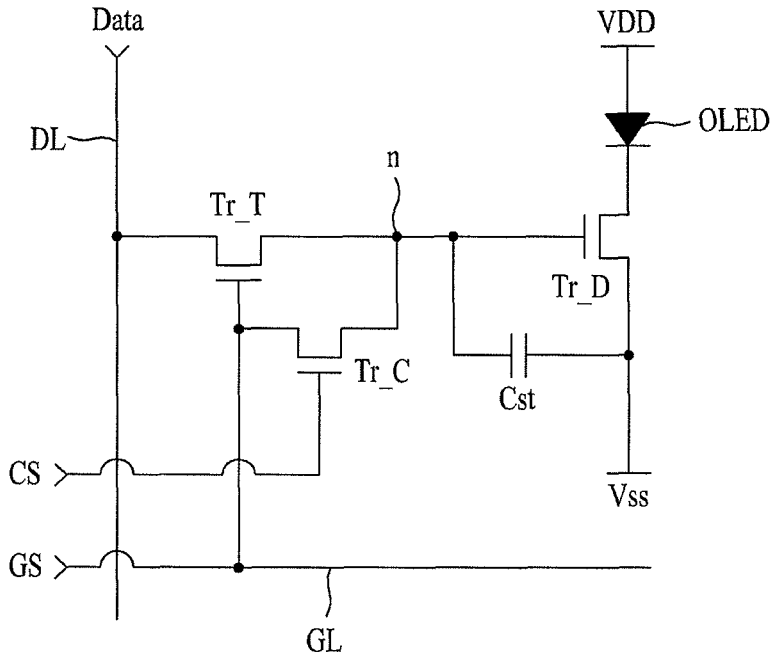
FIG. 3 illustrates a diagram of a circuit of a pixel cell in FIG. 1.

FIG. 3 illustrates a circuitry diagram of a pixel cell in FIG. 1.

Referring to FIG. 3, the pixel cell includes a light emitting diode OLED, a signal transmission switching device Tr_T, a drive switching device TR_D, a control switching device Tr_C, and a storage capacitor Cst.

The light emitting diode OLED for receiving a drive current controlled by the drive switching device Tr_D to emit the light, has a cathode connected to a drain electrode (or a source electrode) of the drive switching device Tr_D and an anode n connected to the first drive power line.

The signal transmission switching device Tr_T connects the data line to the node n in response to the first gate high voltage VGH from the gate line. For this, the signal transmission switching device Tr_T has a gate electrode connected to the gate line, a drain electrode (or a source electrode) connected to the data line DLm and a source electrode (or a drain electrode) connected to the node n.

The drive switching device Tr_D controls an intensity of the drive current supplied to the light emitting diode OLED according to a signal state of the node n. For this, the drive switching device Tr_D has a gate electrode connected to the node n, a drain electrode. (or a source electrode) connected to a cathode of the light emitting diode OLED, and a source electrode (or a drain electrode) connected to the second power line which transmits second drive power.

The control switching device Tr_C connects the gate line to the node n in response to the second gate low voltage VGL2 from the gate line and the control signal CS from the control line. For this, the control switching device Tr_C has a gate electrode connected to the control line signal for transmission of the control signal CS, a drain electrode (or a source electrode) connected to a the node n, and a source electrode (or a drain electrode) connected to the gate line. The control signal is a DC voltage having a value greater than a sum of the second gate low voltage VGL2 and the threshold voltage of the control switching device TR_C and smaller than the first gate low voltage VGL1. This can be expressed with an equation as follows.

$$VGL2+Vth(Tr_C)<CS\leqq VGL1 \quad (1)$$

Where, Vth(Tr_C) denotes the threshold voltage of the control switching device Tr_C.

According to this, the control switching device Tr_C is turned on/off depending on a level of the gate signal supplied to the source electrode (an electrode connected to the gate line) of the control switching device Tr_C itself. That is, if the gate signal supplied to the source electrode is a level of the gate high voltage VGH or the first gate low voltage VGL1, a voltage between the gate electrode and the source electrode of the control switching device Tr_C, i.e., a gate-source electrode voltage has a level of a negative polarity. Therefore, if the gate signal supplied to the source electrode of the control switching device Tr_C is the level of the gate high voltage VGH or the first gate low voltage VGL1, the control switching device Tr_C is maintained at a turn off state. However, if the gate signal supplied to the source electrode of the control switching device Tr_C is a level of the second gate low voltage VGL1, the gate-source electrode voltage of the control switching device Tr_C has a level of a positive polarity. Therefore, if the gate signal supplied to the source electrode of the control switching device Tr_C is at the level of the second gate low voltage, the control switching device Tr_C is maintained at a turn on state.

If the control switching device Tr_C is turned on, the source electrode and the drain electrode of the control switching device Tr_C are connected to each other. That is, the gate line and the node n are connected to each other. Then, the node n becomes a negative polarity state by the second gate low voltage VGL2. Eventually, degradation of the drive switching device Tr_D is prevented, which is connected to the node n through the gate electrode.

The storage capacitor Cst, storing the data signal Data for one frame period, is connected between the node n and the source electrode of the drive switching device Tr_D, or the node n and the drain electrode.

The operation of the pixel cell PXL will be described.

Referring to FIGS. 2 and 3, as the gate signal is maintained at the gate high voltage VGH for a data input period T1, the signal transmission switching device Tr_T which receives the gate high voltage VGH through the gate electrode is turned on. According to this, the data signal Data is supplied from the data line DL to the node n through the signal transmission switching device Tr_T turned on thus. Then, the node n has a voltage elevated as much as the data signal Data, to turn on the drive switching device Tr_D which is connected to the node n through the gate electrode. Then, the drive current is generated through the drive switching device Tr_D turned on thus. The drive current is supplied to the light emitting diode OLED, staring to make the light emitting diode to emit the light. In the meantime, since the gate-source electrode voltage of the control switching device Tr_C has a negative polarity for the data input period T1, the control switching device Tr_C is maintained at a turn off state for the period T1.

Then, referring to FIGS. 2 and 3, as the gate signal is maintained at the first gate low voltage VGL1 for a light emission maintaining period T2, the signal transmission switching device Tr_T is turned off, which receives the first gate low voltage VGL1 through the gate electrode. According to this, the node n is floated, such that the node n floated thus has the data signal Data voltage which was supplied for the data input period T1 thereto maintained as it was. According to this, the drive switching device Tr_D is a turned on state for the period T2, and owing to the drive current from the drive switching device Tr_D in the turned on state, the light emitting diode OLED is maintained at a light emitting state. In the meantime, since the gate-source electrode voltage of the control switching device Tr_C has a negative polarity for the light emission maintaining period T2, the control switching device Tr_C is maintained at a turned off state for this period.

Then, as the gate signal is maintained at the second gate low voltage VGL2 for a restoring time period T3, the signal transmission switching device Tr_T which receives the first gate low voltage VGL1 through the gate electrode is maintained at a turn on state. As the gate-source electrode voltage of the control switching device Tr_C is turned to a positive polarity for the restoring period T3, the control switching device Tr_C is turned on for the period T3. Then, the second gate low voltage VGL2 is supplied from the gate line GL to the node n through the control switching device Tr_C turned on thus, causing the node n to discharge to the second gate low voltage VGL2. At the end, since a voltage of the node n drops from the positive polarity voltage of the data signal Data to a negative polarity voltage of the second gate low voltage VGL2, the degradation of the drive switching device Tr_D is prevented.

In order to make the foregoing operation, the gate driver 220 in the light emitting diode display device of the present invention has the following system.

Figure 4:
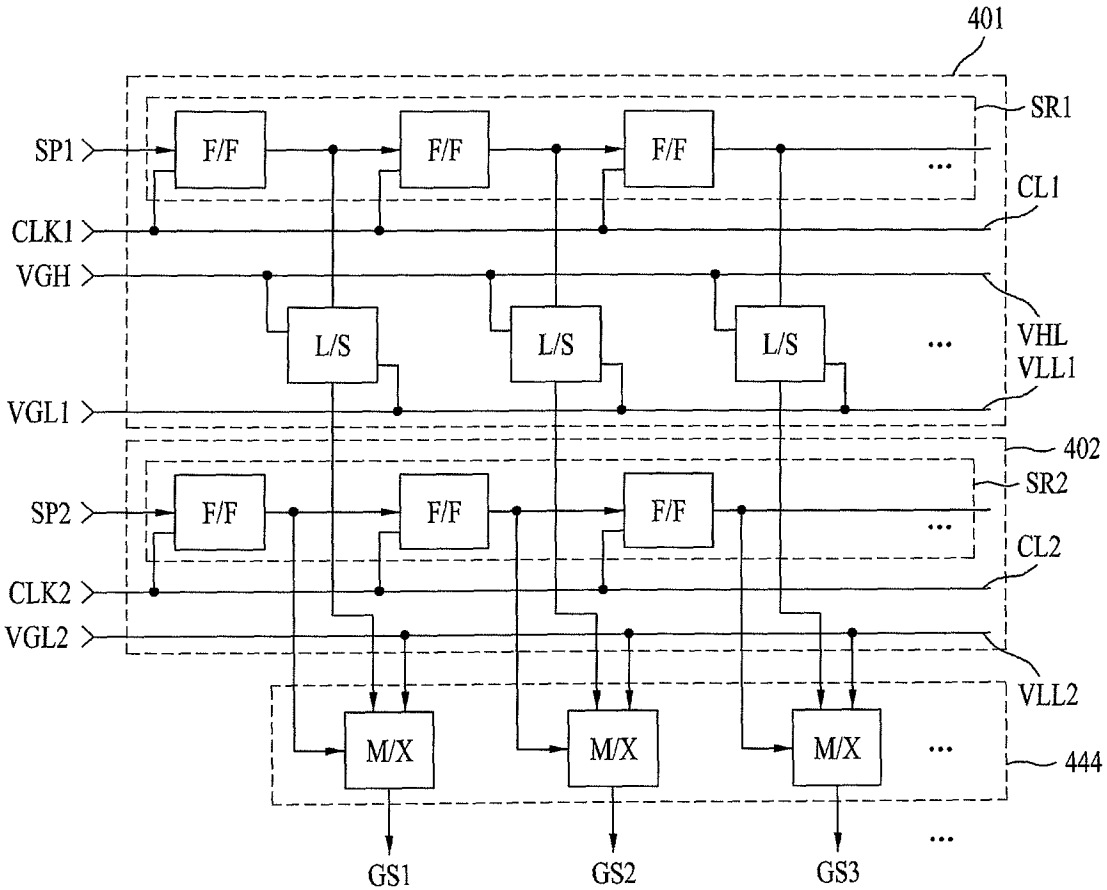
FIG. 4 illustrates a system diagram of a gate driver in accordance with a first preferred embodiment of the present disclosure.

FIG. 4 illustrates a system diagram of a gate driver in accordance with a first preferred embodiment of the present invention.

Referring to FIG. 4, the gate driver includes a first driver 401, a second driver 402, and a selector 444.

The first driver 401 generates the gate high voltage VGH and the first gate low voltage VGL1 by using the first start pulse SP1 and the first clock signal CLK1 in succession for supplying to the gate lines, and the second driver 402 generates the second gate low voltage VGL2 by using the second start pulse SP2 and the second clock signal CLK2 in succession for supplying to the gate lines.

The selector 444 selects one of outputs from the first and second drivers 401 and 402 and forwards to the gate lines.

The first driver 401, the second driver 402, and the selector 444 will be described in more detail.

The first driver 401 includes a first shift register SR1 and a plurality of level shifters L/S.

The first shift register SR1 shifts the first start pulse SP1 according to the first clock signal CLK1, and forwards the first start pulse SP1 shifted thus in succession. The first shift register SR1 includes a plurality of flip-flops. F/F connected to a first clock transmission line CL1 in common which transmits the first clock signal CLK1. A number of the flip-flops F/F are the same with a number of the gate lines. Each of the flip-flops F/F receives an output from a prior stage flip-flop as a start pulse, and shifts and forwards the output according to the first clock signal CLK1. Of the flip-flops F/F, the first flip-flop F/F positioned at the leftmost side on the drawing receives the first start pulse SP1 from an outside of the driver 401. An output from each of the flip-flops F/F is supplied to an input terminal of a next flip-flop and is used as an output from the first shifter SR1. According to this, an output is provided from the output terminals of the first shift register SR1 in succession, and the outputs provided in succession thus are supplied to respective level shifters L/S. A number of the level shifters L/S are the same with a number of the flip-flops F/F.

Each of the level shifters L/S selects and forwards one of the gate high voltage VGH and the first gate low voltage VGL1 depending on logics of the outputs from the first shift register SR1. The level shifters L/S are connected to a high voltage transmission line VHL which transmits the gate high voltage VGH and a first low voltage transmission line VLL1 which transmits the first gate low voltage VGL1 in common. That is, if the output from any one of output terminals of the first shift register SR1 is at high logic, any one of the level shifters L/S selects and forwards the gate high voltage VGH. Opposite to this, if the output from any one of output terminals of the first shift register SR1 is at low logic, any one of the level shifters L/S selects and forwards the first low gate voltage VGL1.

The second driver 402 includes a second shift register SR2 and a low power generating unit.

The second shift register SR2 shifts the second start pulse SP2 according to the second clock signal CLK2, and forwards the second start pulse SP2 shifted thus in succession. The second shift register SR2 includes a plurality of flip-flops F/F connected to a second clock transmission line CL2 in common, which transmits the second clock signal CLK2. A number of the flip-flops F/F are the same with a number of the gate lines. Each of the flip-flops F/F receives an output from a prior stage flip-flop as a start pulse, and shifts and forwards the output according to the second clock signal CLK2. Of the flip-flops F/F, the first flip-flop F/F positioned at the leftmost side on the drawing receives the second start pulse SP2 from an outside of the driver 402. An output from each of the flip-flops F/F is supplied to an input terminal of a next flip-flop and is used as an output from the second shifter SR2. According to this, an output is provided from the output terminals of the second shift register SR2 in succession, and the outputs provided in succession thus are supplied to respective level shifters L/S. A number of the level shifters L/S are the same with a number of the flip-flops F/F.

The low power generating unit generates the second gate low voltage VGL2. The second gate low voltage VGL2 is supplied to the second low voltage transmission line VLL2.

The selector 444 includes a plurality of multiplexers M/X in correspondence to the level shifters L/S. Each of the multiplexers M/X selects one from the output from the level shifter L/S and the output from the second low voltage transmission line depending on logic of an output from the second shift register SR2. That is, each of the multiplexers M/X selects the gate high voltage VGH or the first gate low voltage VGL1 from the level shifters L/S when the output from the second shift register SR2 is at low logic, and the second gate low voltage VGL2 from the low power generating unit when the output from the second shift register SR2 is at high logic.

According to a structure of the gate driver 200 in accordance with the first preferred embodiment of the present invention, the first shift register SR1 generates outputs in succession in response to the first start pulse SP1 at first, and after generation of the specific outputs of the first shift register SR1, the second shift register SR2 starts to generates the outputs in succession following the generation of the second start pulse SP2. In other words, the outputs from the output terminals of the first shift register SR1 are provided before the outputs from the output terminals of the second shift register SR2, respectively.

In this instance, each of the multiplexers M/X receives an output from the first shift register passed through the level shifter L/S and the second gate low voltage VGL2 from the second low power transmission line, and selects and forwards the gate high voltage VGH and the first gate low voltage VGL1 in succession if the output of the second shift register SR2, i.e., the output from the flip-flop F/F of the second shift register SR2 is at low logic. Then, the multiplexer M/X selects and forwards the second gate low voltage VGL2 in succession if the output of the second shift register SR2 (i.e., the output from the flip-flop F/F of the second shift register SR2) is at high logic. According to this, the gate signals from one of the multiplexers M/X have levels of the gate high voltage VGH, the gate low voltage, VGL1, and the second gate low voltage VGL2 in a sequence. In this instance, the gate high voltage VGH is provided for the data input period T1, the first gate low voltage VGL1 is provided for the light emission maintaining period T2, and the second gate low voltage VGL2 is provided for the restoring period T3. In the meantime, the output after the restoring period T3 has a level of the first gate low voltage VGL1.

In this instance, one output from one multiplexer is supplied to one gate line. That is, the output terminal of a k(th) multiplexer M/X is connected to a k(th) gate line (k is a natural numeral).

The gate driver 200 of the present invention may have the following system.

Figure 5:
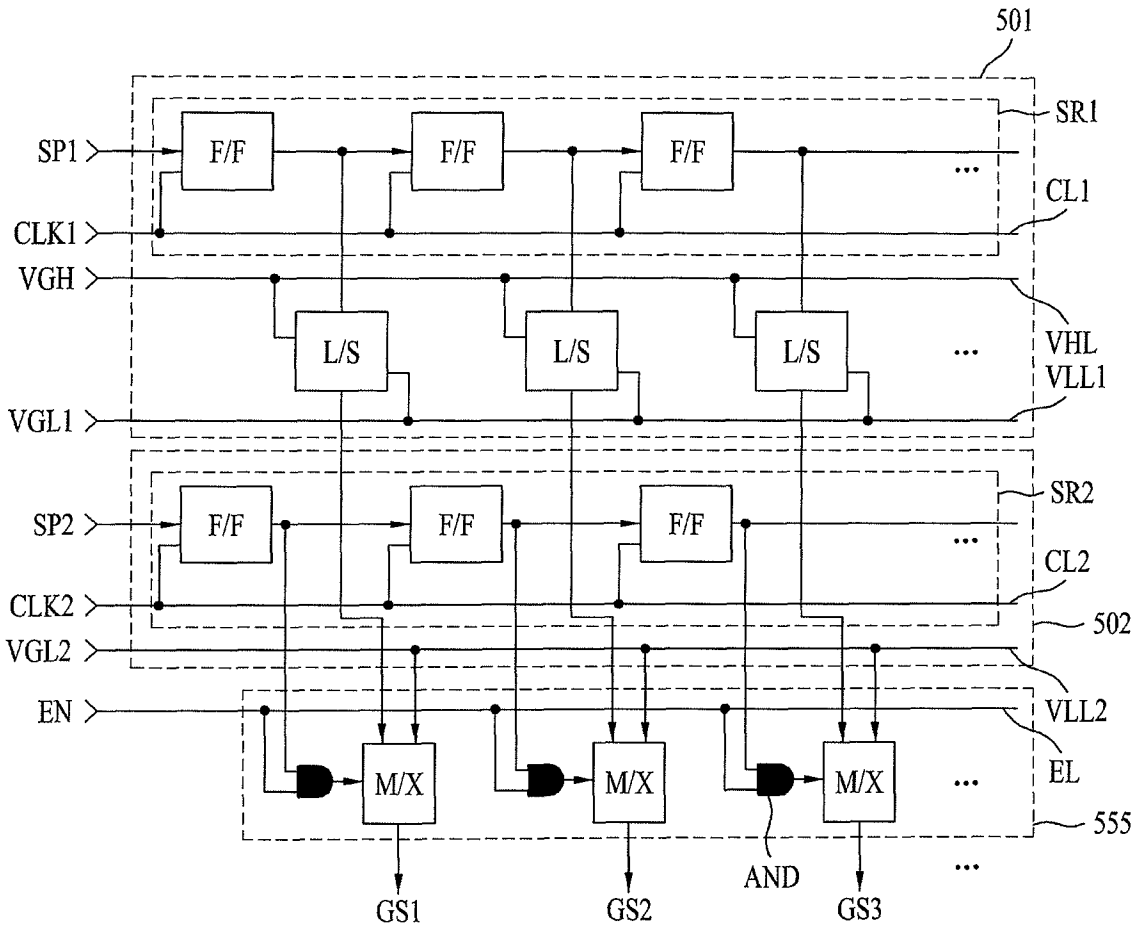
FIG. 5 illustrates a system diagram of a gate driver in accordance with a second preferred embodiment of the present disclosure.

FIG. 5 illustrates a system diagram of a gate driver in accordance with a second preferred embodiment of the present disclosure.

Referring to FIG. 5, the gate driver 200 includes a first driver 501, a second driver 502, and a selector 555. Since the first and second drivers 501 and 502 are identical to the first and second drivers 401 and 402, description of which will be omitted.

The selector 555 includes a plurality of multiplexers M/X corresponding to the level shifter L/S, a plurality of logic sum gates AND for making logical operation of the outputs from the second shift register SR2 and an external enable signal EN. The enable signal EN is transmitted through an enable transmission line EL.

The multiplexers M/X select the gate high voltages VGH or the first gate low voltages VGL1 from the level shifters L/S respectively when an output from the logic sum gate AND is at low logic, and the second gate low voltages VGL2 from the low power generating unit respectively when the output from the logic sum gate AND is at high logic. The enable signal EN is maintained at the low logic for a period the gate high voltage VGH and the first gate low voltage VGL1 are applied to every one of the gate lines GL1 to GLn once, and is maintained at the high logic in a period thereafter. That is, the enable signal EN and the logic sum gate AND prevents the second gate low voltage VGL2 from supplying to the gate lines GL1 to GLn for the period in which the gate high voltages VGH and the first gate low voltages VGL1 are supplied to the gate lines from the first driver 501. Of course, alike the first embodiment, though the supply of the second gate low voltage VGL2 to the gate lines GL1 to GLn for above period can be prevented by making the first and second start pulses SP1 and SP2 to be provided in periods different from each other even without the enable signal EN and the logic sum gate AND additionally, the addition of the enable signal EN and the logic sum gate AND permits to prevent malfunction liable to cause by distortion of a signal, positively.

As has been described, the light emitting display device of the present invention has the following advantages.

The supply of a voltage having a polarity opposite to a data signal to a gate electrode of the drive switching device in each period, restoring a threshold voltage of the drive switching device to an original value, prevents the drive switching device from degrading.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A light emitting diode display device comprising:

a plurality of pixel cells having a light emitting diode;

a plurality of data lines for transmission of data signal having information on a picture;

a plurality of gate lines for transmission of a gate signal having a gate high voltage, a first gate low voltage, and a second gate low voltage having a polarity opposite to the data signal, wherein the gate high voltage, the first gate low voltage and the second gate low voltage have potentials different from one another;

wherein each of the pixel cells includes;

a signal transmission switching device that connects the data line to a node according to the first gate high voltage from the gate line, a drive switching device that controls an intensity of a drive current being supplied to the light emitting diode according to a signal state of the node, a storage capacitor connected between the node and a source electrode or a drain electrode of the drive switching device, and a control switching device that connects the gate line to the node in response to the second gate low voltage from the gate line and a control signal from a control line;

wherein the first gate low voltage is lower than the gate high voltage, and the second gate low voltage is lower than the first gate low voltage, and the control signal is a DC voltage higher than a sum of the second gate low voltage and a threshold voltage of the control switching device, and lower than the first gate low voltage.

2. The device as claimed in claim 1, wherein the data signal is supplied to the node for a data input period in which the gate signal is maintained at the gate high voltage, the data signal supplied to the node is maintained for a light emission maintaining period in which the gate signal is maintained at the first gate low voltage, and the second gate low voltage is supplied to the node for a restoring period in which the gate signal is maintained at the second gate low voltage.

3. The device as claimed in claim 1, further comprising a gate driver that drives a plurality of gate lines, wherein the gate driver includes;

a first driver that generates the gate high voltage and the first gate low voltage in succession by using a first start pulse and a first clock signal for supplying to the gate lines, a second driver that provides the second gate low voltage in succession by using a second start pulse having a pulse width greater than the first start pulse and provided later than the first start pulse and a second clock signal having a pulse width greater than the first clock signal for supplying to the gate lines, and a selector that selects one from outputs of the first and second drivers and forwarding the output selected thus to the gate lines.

4. The device as claimed in claim 3, wherein the first driver includes a first shift register that shifts the first start pulse according to the first clock signal and forwards the first start pulse shifted thus in succession, and a plurality of level shifters that select one from the gate high voltage and the first gate low voltage depending on logic of forwarding from the first shift register, and forward one selected thus in succession, the second driver includes a second shift register that shifts and forwards the second start pulse according to the second clock signal in succession, and a low power generating unit that generates the second gate low voltage, and the selector includes a plurality of multiplexers corresponding to the level shifters, wherein the multiplexers select the gate high voltages or the first gate low voltages from the level shifters respectively at the time an output from the second shift register is at low logic, and the second gate low voltage from the low power generating unit at the time an output from the second shift register is at high logic.

5. The device as claimed in claim 3, wherein the first driver includes a first shift register that shifts and forwards the first start pulse according to the first clock signal in succession, and a plurality of level shifters that select one from the gate high voltage and the first gate low voltage depending on logic of outputs from the first shift register and forward the one selected thus, the second driver includes a second shift register that shift and forward the second start pulse according to the second clock signal in succession, and a low power generating unit for generating the second gate low voltage, and the selector includes a plurality of multiplexers corresponding to the level shifters and a plurality of logic sum gates that make logical operation of the outputs from the second shift register and an external enable signal, wherein the multiplexers select the gate high voltage or the first gate low voltage from the level shifters respectively at the time an output of the logical sum gate is at low logic, and the second gate low voltage from the low power generating unit at the time the output from the logical sum gate is at high logic.

* * * * *